United States Patent [19]

Eldridge

[11] 4,432,745

[45] Feb. 21, 1984

[54] TRAILING EDGE FOLDER

[75] Inventor: Charles W. Eldridge, Beverly, Mass.

[73] Assignee: Paxall, Inc., Chicago, Ill.

[21] Appl. No.: 375,574

[22] Filed: May 6, 1982

[51] Int. Cl.[3] ..... B31B 1/54

[52] U.S. Cl. ..... 493/10; 493/177; 493/419; 493/453

[58] Field of Search ..... 493/10, 28, 30, 419–421, 493/425, 453, 177

[56] References Cited

U.S. PATENT DOCUMENTS 3,330,185 7/1967 Annett et al. .
3,901,134 8/1975 Reizenstein et al. .
4,119,018 10/1978 Nava ..... 493/10

*Primary Examiner*—A. J. Heinz
*Attorney, Agent, or Firm*—Fitch, Even, Tabin & Flannery

[57] ABSTRACT

Apparatus for folding the trailing edge of paperboard blanks conveyed along a straight-line path includes a rotatable shaft disposed below and transverse to the conveyor and having arms with heads at their ends which extend upward through openings between conveyor belts. The shaft is rotated to cause the heads to contact the trailing panels or flaps of the blanks and fold them onto the blank body. To rotate the shaft intermittently it is momentarily connected to a continuously rotating drive by a clutch-brake which permits substantially instantaneous engagement and disengagement. The precise position of each blank is determined by a signal generated by a photodetector, and the rotational orientation of the shaft is determined by optical detectors associated therewith. A signal from the photodetector indicating position of the blank is received by a controller which also has input of the conveyor speed and which responds by actuating the clutch-brake at the proper time.

18 Claims, 5 Drawing Figures

TRAILING EDGE FOLDER

The present invention relates to apparatus for folding carton blanks and more particularly to apparatus for folding the trailing panels of carton blanks conveyed along a straight-line path.

BACKGROUND OF THE INVENTION

In processing lines where carton blanks are conveyed along a straight-line path for folding and gluing, it is relatively straightforward to engage the leading and lateral edge panels of a flat blank with plows, etc, and fold them into position for gluing. It remains a problem, however, to engage and fold the trailing panel and/or flaps of carton blanks. One solution has been to provide two processing lines at right angles to each other in what is known as an Right-Angle Gluer, a solution which is duplicative of equipment and generally wasteful of space. Another solution has been to lock the blanks onto dogs on a continuously moving chain that is calibrated to a Geneva mechanism that in turn actuates fingers which fold the trailing panels, a solution which entails considerable expense. A trailing edge folder for operating with a mechanically timed feed which employs a shaft that is intermittently rotated in conjunction with the timed carton feed is shown in U.S. Pat. No. 3,330,185.

A device for folding the trailing edges of carton blanks that has met with considerable success is described in U.S. Pat. No. 3,901,134. An endless loop having a run below the carton blank conveyer is intermittently operative and carries pivotal folding fingers that are biased to a rest position and pivoted by various cams as the finger is carried below the carton blank to engage and fold its trailing end flap. While the mechanism is adjustable to accommodate blanks of various sizes and does not require a mechanically timed feed, its speed in handling small carton blanks is limited by the speed at which successive fingers are carried onto the upper run of the loop, and smaller boxes or cartons may have to be spaced at substantial intervals from each other thereby reducing the efficiency of the apparatus. Although the speed of the fingers might be adjusted by changing the geometry of the fingers and loop, such changes are cumbersome and such apparatus is generally operated at a constant speed.

The need continues for apparatus with greater versatility for folding the trailing panels and/or flaps of carton blanks.

SUMMARY OF THE INVENTION

Accessory apparatus is provided for use in combination with a blank folding machine having support means for continuously advancing blanks in a predetermined direction along a horizontal path. A rotatable shaft mounted below and transverse to the path is intermittently rotatable and carries an arm or arms that extend generally radially therefrom and have heads at their ends for contacting and folding the trailing panels of the successive blanks. A sensor detects the trailing edge of a carton blank and sends a signal to a controller which actuates the shaft to begin rotation, at a predetermined time following receipt of the signal, to bring the heads into contact with the panel and fold it along a line parallel to the trailing edge. The controller causes the shaft to pause at a rotational position whereat the trailing panel edge is folded about 180° about the fold line. After the trailing panel is pulled from under the heads and the blank is out of the path of the heads, the controller causes the shaft to rotate to its dwell position.

IN THE DRAWINGS

DETAILED DESCRIPTION OF THE PREFERRED EMBODIMENT

Figure 1:
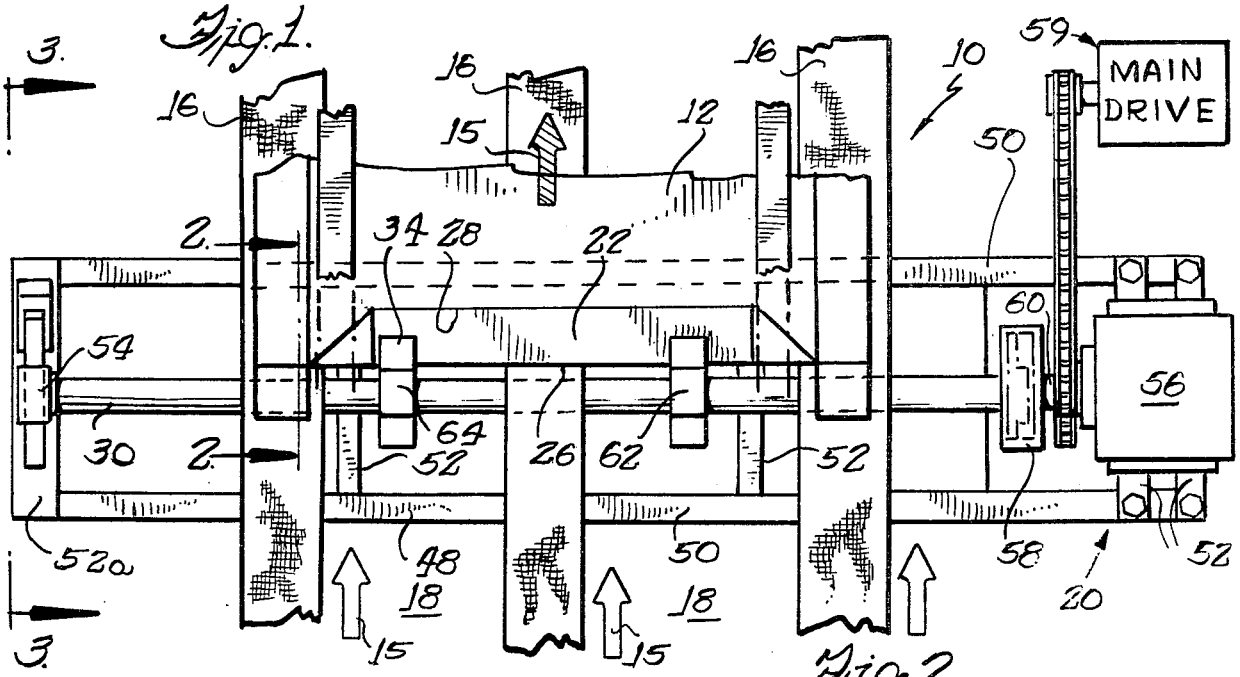
FIG. 1 is a plan view of a portion of a carton blank conveyor and apparatus embodying various features of the invention associated therewith for folding trailing panels or flaps of carton blanks.
Figure 1A:
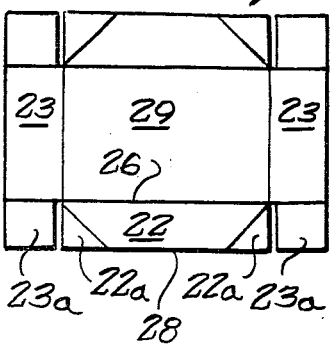
FIG. 1A is a plan view of a carton blank.

Illustrated in FIG. 1 is a small portion of a carton blank folding machine 10 or folder-gluer in which carton blanks 12 are supported and continuously advanced by a conveyer 14 in a predetermined direction 15 along a generally horizontal path. The illustrated conveyer 14 consists of three parallel belts 16 spaced apart to provided two open regions or openings 18 therebetween through which blank-contacting members of folding apparatus, indicated generally at 20, imtermittently protrude. These belts 16 in the usual folder-gluer may be 1 to 2 inches wide and are laterally adjustable to appropriately locate them relative to the size and shape of the blanks being handled. In the section of the folder-gluer illustrated, the blank 12 is conveyed by engagement of its side panels 23 between the two outside belts 16 and cooperating upper belts (not shown). The associated folding apparatus 20 engages the trailing panel 22 of each blank 12 and folds it about 180°, along a transverse fold line 26, parallel to the trailing edge 28, positioning the panel against the body or central panel 29 of the blank 12. The blank 12 is of standard shape and is shown in FIG. 1A in flat form. The panel 22 has a pair of triangular subpanels **22*a*, and the side panels 23 have trailing flaps 23*a***. The standard folding process is illustrated and explained in the aforementioned U.S. Pat. No. 3,330,185.

Figure 4:
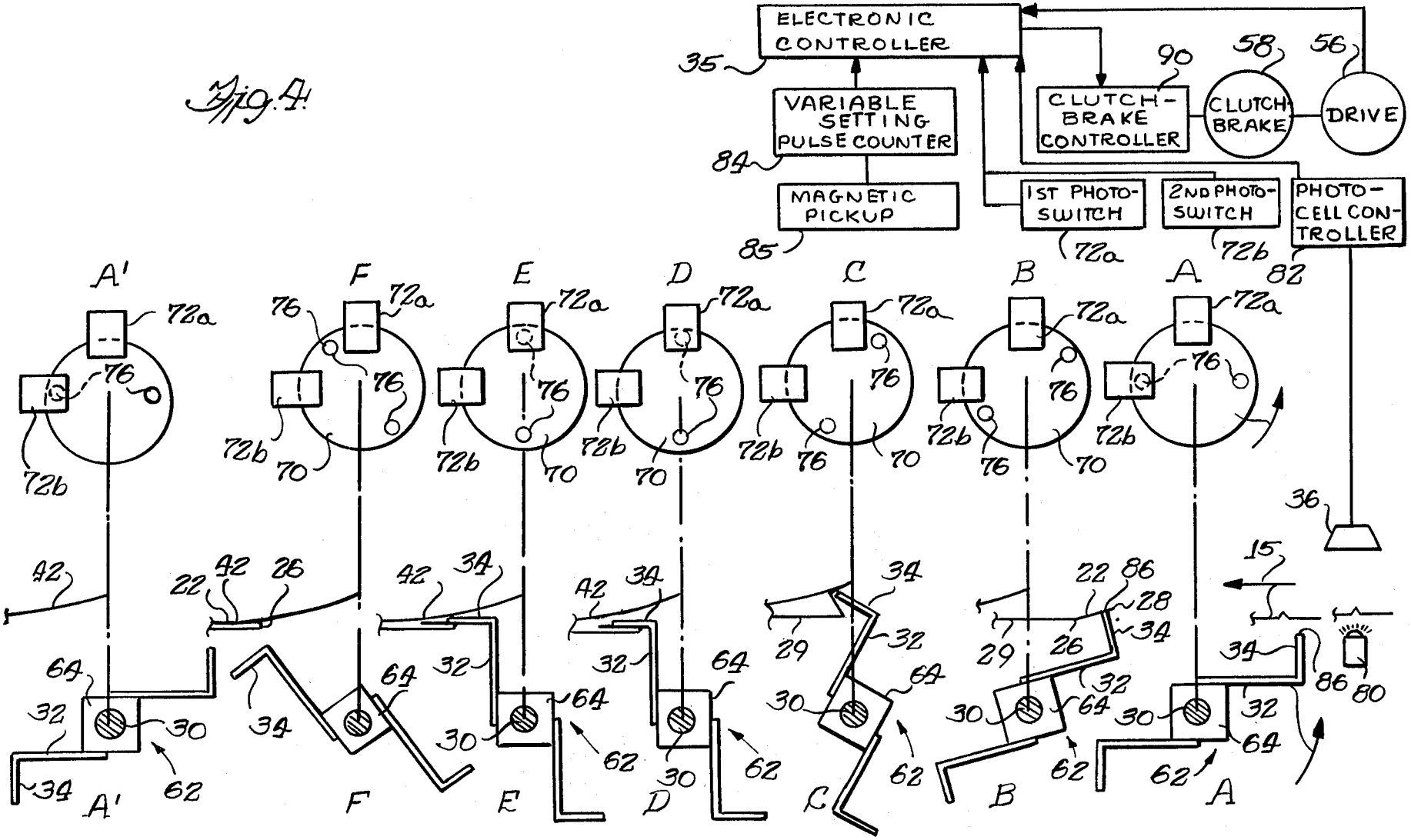
FIG. 4 is a schematic view showing several orientations of the rotating shaft of the apparatus and the attached arm means which fold the trailing panel, corresponding orientations of an optically detectable encoder wheel carried by the shaft and a diagrammatic illustration of a control system that operates the folding apparatus.

In accordance with the present invention, the apparatus 20 assures folding of the trailing panel 22 of substantially any size carton blank 12 as it passes thereabove. In a downstream section of the folder-gluer, a similar mechanism is employed to fold the two training flaps **23*a*. The apparatus 20 has a rotatable shaft 30 disposed below the conveyer 14 that carries generally radially extending arm means 32 having heads 34 at their ends for engaging and folding the trailing panels 22 forward or downstream in the direction of the conveyer. An electronic controller 35 (FIG. 4) operates the shaft 30 intermittently, causing the shaft to rotate at about 90° increments. A predetermined interval after a sensing means or detector 36 detects passage of the trailing edge 28 of a carton blank 12, the arms 32 are rotated until their heads 34 contact the panel 22 and fold it inward against the body 29 of the blank. When the heads 34 are generally horizontal (position D, FIG. 4), having pivoted the trailing edge 28 of the panel 22 about 180° about the parallel fold line 26, the controller 35 effects immediate cessation of shaft rotation until the panel 22 is conveyed downstream and under a hold-down member 42. In the illustrated arrangement, a pair of plows are used as the hold-down members 42 and serve to fold the triangular subpanels 22***a* against the panel 22 as the folding operation takes place. After the folded blank 12 has cleared the path of the heads 34, the controller 35 actuates rotation of the shaft 30 back to its dwell position A'.

The elongated shaft 30 extends across the path of the conveyer 12 and is mounted below an upper run 46 of the conveyer on a rectangular support frame 48 having a pair of elongated tubular members 50 transverse to the conveyer run joined by several tubular cross pieces 52. At one end, the shaft 30 is journaled for rotation within a bearing bracket 54 mounted on an end crosspiece 52*a* and at its other end is connected to a drive motor 56 via a clutch-brake assembly 58 which is supported on the frame 48 straddling the perpendicular members 50. The drive motor 56 can be a variable speed electric motor which would permit the shaft 30 to be rotated at any different speeds, a feature which helps to adjust the apparatus 20 for folding panels 22 of longer lengths.

It has been found preferable to connect a mechanical speed variation device to the main power drive 59 of the conveyor (or folder-gluer) and use this as the drive motor 56; in this manner, the speed of the shaft 30 is automatically adjusted in proportion to any change in conveyor speed. In general, a device that would permit adjustments between about 1.6:1 and 2.0:1 (tangential head speed: linear belt speed) is considered adequate. The clutch-brake 58 links the elongated shaft 30 to the drive output shaft 60 and allows the elongated shaft 30 to be substantially instantaneously engaged and disengaged from the rotation of the motor and substantially instantaneously braked. The clutch-brake 58 may be operated electromagnetically if no more than about 300 off-on cycles are needed. However, a pressure- or vacuum-mechanical clutch-brake 58 is preferably used, e.g. one of the type disclosed in U.S. Pat. No. 3,378,121. Such clutch-brakes are sold under the name VAC-U-TORQ by Foret Systems, Inc. of Waquoit, Mass. U.S.A. which can achieve 1000 cycles per minute and have an 8 millisecond response time. When the clutch-brake 58 is engaged, the shaft 30 rotates at the speed of the output shaft 60, but when the clutch-brake is disengaged from the output shaft, it immediately brakes either at a pause position D, where the arms 32 are vertical having just folded a flap 22, or in the dwell position A where the arms are removed from the path of blank travel.

In the illustrated apparatus, the shaft 30 carriers two axially spaced-apart assemblies 62 each having two oppositely extending arms. The two arms distribute impact and folding forces across the panels 22 helping to overcome the deflection of a paperboard panel during folding which commonly may be between about 0.012 and 0.030 inch thick. Additional assemblies of arms might be used with appropriate conveyer belts on apparatus for folding very wide carton blanks. The opposed arms 32 of each set 62 maintain the rotational balance of the shaft 30 and complete a folding cycle between one dwell position A and the next during only a 180° rotation of the shaft.

Figure 2:
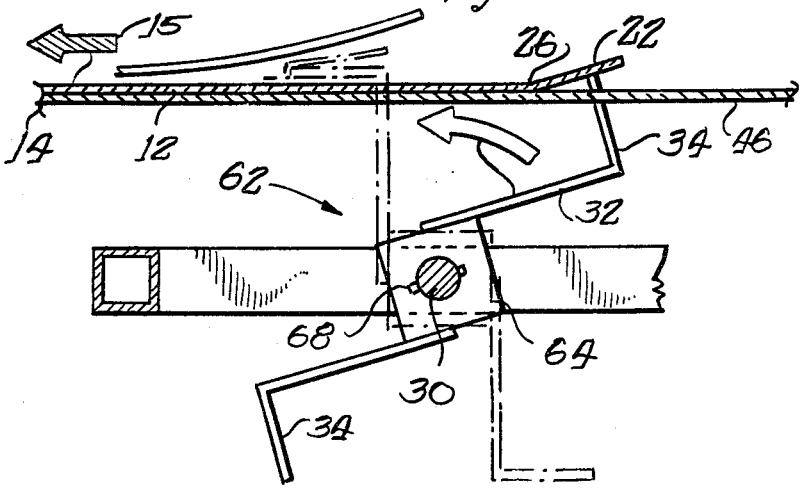
FIG. 2 is a cross-sectional view taken along line 2—2 of FIG. 1.
Figure 3:
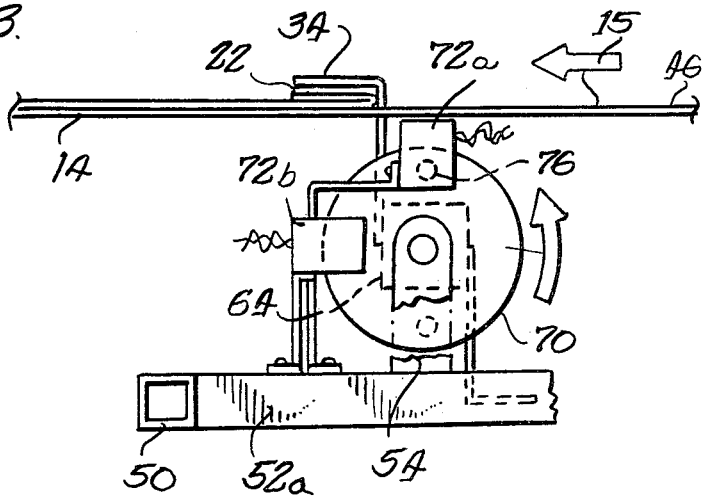
FIG. 3 is an end view taken along line 3—3 of FIG. 1.

Each arm 32 is offset somewhat from a radial orientation shaft centerline and carries a straight head portion 34 at its end. The heads 34 are perpendicular to the arm 32 and rotate from a vertical orientation in the dwell position A, completely removed from the path of blank travel, to a horizontal orientation in the pause position D holding the panel 22 against the body 29 of the blank. As seen in FIG. 2, the arms 32 are mounted on blocks 64 keyed to the shaft for rotation therewith by a mating key and keyway arrangement 68. The blocks 64 space the arms 32 apart from the shaft centerline a preset distance in the direction of conveyer travel in the pause position D and slightly increase the length of time during which the heads 34 are moving in contact with the panel 22 between initial contact and reaching the pause position D.

As a means of accurately determining the angular position of the shaft 30 so that the controller 35 may actuate the clutch-brake 58 at one end of the shaft to stop rotation of the shaft 30 at precise predetermined angular orientations A,D, and encoding wheel 70 is mounted near the other end of the shaft adjacent the bracket 54. A pair of optical detectors 72*a*, 72*b* are disposed along the encoding wheel 70 to read the shaft orientation from the encoding wheel. The illustrated encoding wheel 70 has a pair of diametrically opposed optical indicators 76, and the optical detectors 72 are mounted 90° from each other with respect to rotation of the shaft for determination of the pause D and the dwell A shaft orientations corresponding to the alignment of one of the indicators with either the first detector 72*a* or second detector 72*b*, respectively. The indicator 76 may be openings or holes through the encoder wheel, and the optical detectors 72 provide a light source at one side of the wheel 70 and a photocell at the other, positioned to detect passage of a light beam through one of the openings 76. On each cycle of operation, one of the openings 76 rotates 90° to the first detector 72*a* and then 90° to the second detector 72*b*. Alternatively, four evenly spaced holes 76 could be used with only a single detector 72.

As a means of very precisely determining the position of the carton blanks 12 carried by the conveyer 14, a light source 80 and the detector 36 in the form of a photocell are positioned on opposite sides of the passing blanks 12 to detect the passage therebetween of a blank by the intermittent interruption of the light beam from the source to the photocell. Alternatively, a photocell 36 which reads reflected or diffuse light from its own source could be used. The blank-detecting photocell 36 is connected via a photocell controller 82 to the electronic controller 35. A pulse counter 84 receives a pulse signal from a magnetic pick-up 85 or the like associated with a disc carried on a shaft of the conveyor and computes the linear speed of the box blanks 12 according to the timing of the pulses. For example, each pulse may indicate belt travel of 0.01 inch, and such pulse counters and magnetic pick-ups are well known in the art. The pulse counter 84, in turn, inputs the velocity information to the electronic controller 35 which also receives information relating to the position of the individual carton blank directly from the photocell controller 82. The electronic controller 35 initiates the rotational folding cycle of the shaft 30 after a calculated interval following sensing the position of the trailing edge 28 of each carton blank 12, and the length of time of this calculated interval will vary according to the speed of blank travel. Such an electronic controller is well within the present state of the control art used to start automatic gluers and the like, and electronic control systems adequate to function in the stated manner can be obtained from suppliers such as Chet Zak and Associates, Newburyport, Massachusetts, Valco Cincinnati, Cincinnati, Ohio and Mactron Inc., Worth, Ill.

The speed of the drive motor 56 is separately set to rotate the shaft 30 at a sufficient rate that the speed of the outer contact end 86 of the head 34 moves in the downstream direction sufficiently faster than the conveyor to overtake and fold the traveling blank 12. The speed of the variable speed drive unit 56 can be monitored by the electronic controller 35. Typically, the tangential speed of the head is about 1.8 times the linear speed of the blanks. If the drive unit 56 takes its power from the conveyor main drive, the shaft 30 will be rotated at the same relative speed regardless of whether the speed of the conveyor is increased or decreased, which is an advantage when changing production speed. The precise speed of the drive unit can be adjusted after taking in consideration the length of the panel 22 in the direction of carton blank travel. A longer panel 22 may offer more or less resistance to folding than a shorter panel, and should the blank be made of relatively stiff material, e.g., corrugated board, it may be desirable for the head to contact the flap a greater relative distance from the fold line 26 (relative to the length of the panel). To accomplish this change in relative point of initial contact, the relative speed of the drive unit is increased so that the faster speed of the folding head allows it to contact the flap 22 further behind the fold line 26 yet catch up to achieve the 180° swinging of the panel.

Coordination of the rotation of the shaft 30 with the travel of the blanks 12 is very precisely controlled to engage the shaft with the drive unit 56 via the clutch-brake based upon accurate calculated speed and position of a blank 12, rather than just attempting to rely upon a set speed of a conveyer or a delivery point spacing of blanks from one another. The electronic controller 35 receives an input indication of the precise position of the trailing edge 28 of a blank 12 from the photocell controller 82 and monitors the speed of the drive unit (or alternatively receives an indication of its speed relative to the conveyor). Manually set into the controller 35 is the length of the panel 22 or flaps being folded, and the controller calculates a predetermined interval based upon the length of the panel before initiating the cycle by energization of the clutch-brake 58. The interval may be thought of as the increment of blank travel before sending the signal to operate the clutch 58 (taking response time into consideration) so that the contact end 86 of the head 34 strikes the panel at the desired relative-point between the fold line 26 and the trailing edge 28. For relatively long or stiff panels, a manual increase in drive unit speed causes the head to contact the panel 22 relatively closer to its trailing edge 28 as mentioned hereinbefore.

In the starting or dwell position A, the shaft 30 is positioned so that its arms 32 are horizontal, and the heads 34 vertical. In this position, one of the encoding wheel openings 76 is aligned with the detector **72*b*, and the second opening is located 90° from the other detector 72*a*. Upon a signal from the electronic controller 35, a clutch-brake controller 90 energizes the clutch-brake 58 immediately engaging the shaft 30 with the drive unit output shaft 60 that is rotating at its predetermined speed. Initial contact between the parallel heads 34 and the underside of the panel 22 occurs at position B, the heads 34 striking the panel with sufficient force to bend the panel upward along its fold line 26. As the shaft 30 continues to rotate, the parallel heads 34 push the panel 22 upward into contact with the plows 42 bending the subpanels 22*a* backward as the remainder of the panel 22 is forced downward towards the body 29 of the blank 12 (position C). When the heads 34 reach their horizontal position D where the panel 22 lies flat against the blank body 29 and the triangular subpanels 22*a* are bent backward, shaft rotation is immediately halted at this point. The opening 76 which was initially 90° away from the first photodetector 72*a* has moved into alignment therewith, and reestablishment of the light beam of the first detector 72*a* through the opening 76 sends a signal to the electronic controller 35 which, in turn, signals to the clutch-brake controller 90 to effect disengagement of the shaft 30 from the drive unit 60, immediately braking the shaft in the pause position D. Although the shaft cannot be stopped instantaneously upon the activation of the photodetector because there must be some finite response time (during which the hole 76** will drift slightly past the 12 o'clock position), the hole is shown as though the wheel stopped immediately for ease and clarity of explanation.

Downstream of this location, the plows 42 serve as hold-down members spaced just above the conveyer to capture the folded panel 22 and subpanels **22*a* in position against the body 29 as the blank is pulled from beneath the heads 34. The shaft 30 remains in its pause orientation as the folded blank 12 moves downstream with the panel 22 sliding from beneath the heads 34 (position E). After a predetermined interval of belt travel, as computed by the electronic controller 35, during which the blank has entirely cleared the path of the heads 34, the clutch-brake controller 90 is signalled to reenergize the clutch-brake 58. The shaft 30 rotates (position F) until the arms 32 are again horizontal in dwell position A', identical to but 180° from the initial dwell position A. In this position, one of the encoder wheel openings 76 has moved 90° from the first detector 72*a* to the second detector 72*b*. Reestablishment of the beam of the second detector 72*b* through the encoder wheel 70 results in disengagement of the clutch and braking of the shaft 30 in its dwell position A' preparatory for the next cycle with both arms horizontal and below the conveyor. Thus, when either detector 72 receives a light beam, the shaft 30 is immediately braked. The trailing flaps 23*a*** are folded by a similar apparatus located downstream, and as used throughout this application, trailing "panel" should also be understood to include two flaps.

The invention solves the long-standing problem of how to fold trailing panels of untimed carton blanks at high speed and has been operated at as high as 30,000 cartons an hour. The panels are positively engaged and folded with precise timing, as determined by the actual position of the blanks and by the calculated speed of the conveyor, which makes very high speed production possible without the long set-up time which accompanied any changeover from one blank size to another in a timed feed machine. By adjustments in the speed of the drive unit, blanks with panels of substantial length or different characteristics are accommodated. Adjustment of the apparatus for different blanks is accomplished quickly by simply setting the length of the trailing panel into the electronic controller. Differences in the length of the center panel 29 require no adjustment because the apparatus 20 is guided by the location of the trailing edge only. Moreover, the trailing edge folder can be simply disabled to allow standard folder-gluer operation.

While the invention has been described in terms of a preferred embodiment, modifications obvious to one with ordinary skill in the art may be made without departing from the scope of the invention. For example, at substantial changes in the speed of production, a simple compensation factor can be set into the controller to take into account inertia components and response intervals which vary slightly at such different speeds, i.e., it will take a very slightly longer time interval to halt the shaft 30 at faster speeds, and this is built into the controller and adjusted by the entry of the compensation factor. Additional detector means can be provided for alignment with a notch in the periphery of the wheel when the arms are perfectly horizontal in the dwell or park position to ascertain whether the correct compensation adjustment has been set in or some slight further adjustment should be made.

Various features of the invention are emphasized in the following claims.

What is claimed is:

1. A trailing edge folding accessory apparatus for use in combination with a carton blank folding machine having support means for continuously advancing blanks in a predetermined direction in untimed relationship to one another along a generally horizontal path in said folding machine, the apparatus operating to fold a trailing blank panel 180° about a fold line that extends generally transverse to said advancement path, which apparatus comprises means for sensing the presence of a blank at a location along said path and providing a signal, a rotatable shaft mounted below said path and transverse thereto, drive means to rotate said shaft, clutch means to alternately associate and dissociate said shaft with the movement of said drive means to cause said shaft to be selectively and uni-directionally rotated from said drive means, brake means to stop said rotating shaft in precise positions, an arm having an inner end and an outer end, said arm being mounted on said shaft at said inner end to extend generally radially therefrom, an elongated head at said outer end of said arm which is carried by said rotating shaft from a first dwell position completely below said path to a second position just above and generally parallel to said path extending horizontally downstream from said outer end, programmable control means connected to said sensing means for operating said clutch means to associate said shaft with said drive means to carry said head from said first position to said second position at a certain instant following detection of said blank at said location, said head while moving from said first position to said second position contacting the underside of the trailing panel and folding the trailing panel 180° about the fold line, said control means operating said clutch means to dissociate said shaft from said drive means and to operate said brake means to pause said shaft with said head in said second position allowing the blank to slide out from under said head, and after a predetermined, adjustable pause period that is programmed into said control means again associating said shaft with said drive means to further rotate same and remove said head to below the said path.

2. Apparatus in accordance with claim 1 having a pair of arms and heads diametrically oppositely mounted from said shaft.

3. Apparatus in accordance with claim 1 wherein said sensing means senses the precise location of the trailing edge of the moving carton blank.

4. Apparatus in accordance with claim 3 wherein said control means is electronic and is adjustable to adapt to trailing panels having a different dimension between the trailing edge and the transverse fold line by entering therein indicia equivalent to said dimension.

5. Apparatus in accordance with claim 1 wherein said drive means is designed to operate at variable speed, and said control means is adapted to monitor said drive means speed and to incorporate same in calculating said certain instant, whereby causing said drive means to operate at a faster speed results in said head means initially contacting the trailing panel of the blank at a location relatively closer to its trailing edge.

6. Apparatus in accordance with claim 5 wherein said clutch means and said brake means are vacuum-operated for immediate starting and stopping of said shaft rotation.

7. Apparatus in accordance with claim 5 wherein said drive means is interconnected with main drive means for said folding machine and automatically rotates at a speed in proportion to the speed of said main drive means.

8. Apparatus in according with claim 1 wherein said clutch means and said brake means are vacuum-operated for immediate starting and stopping of said shaft rotation.

9. Apparatus in accordance with claim 1 wherein plow means is located above said support means where a portion of said trailing panel is engaged and bent backwards as said folding is carried out, said plow means extending downstream of said shaft and serving to hold down said folded panel after its sliding from under said head means.

10. A trailing edge folding accessory apparatus for use in combination with a carton blank folding machine having support means for continuously advancing blanks in a predetermined direction in untimed relationship to one another along a generally horizontal path in said folding machine, the apparatus operating to fold a trailing blank panel 180° about a fold line that extends generally transverse to said advancement path, which apparatus comprises means for sensing the presence of a blank at a location along said path and providing a signal, means for continuously measuring incremental advance of said support means and providing a signal, a rotatable shaft mounted below said path and transverse thereto, means for intermittently rotating and stopping said shaft, an arm having an inner end and an outer end, said arm being mounted on said shaft at said inner end to extend radially therefrom, an elongated head at said outer end of said arm which is carried by said rotating shaft from a first dwell position completely below the path to a second position just above and generally parallel to said path extending horizontally downstream from said outer end, programmable control means connected to said sensing means and said measuring means for operating said shaft-rotating means, said control means operating said shaft-rotating means to carry said head from said first position to said second position following detection of said blank at said location and after a predetermined measured increment of advance of said support means, said head moving from said first position to said second position contacting the underside of the trailing panel and folding the trailing panel 180° about the fold line, said control means operating said shaft rotating means to stop said shaft to cause said head to pause for an adjustable period in said second position allowing the blank to slide out from under said head, and after a predetermined measured increment of advance of said support means, said control means again operating said shaft-rotating means to carry said head to below said path.

11. Apparatus in accordance with claim 10 wherein said control means is electronic and is adjustable to adapt to trailing panels having a different dimension between the trailing edge and transverse fold line by entering therein indicia equivalent to said dimension.

12. Apparatus in accordance with claim 10 wherein plow means is located above said support means where a portion of said trailing panel is engaged and bent backwards as said folding is carried out, said plow means extending downstream of said shaft and serving to hold down said folded panel after sliding from under said head.

13. Apparatus in accordance with claim 10 wherein said folding machine has main drive means and said shaft rotating means includes drive means that is interconnected with said main drive means and automatically rotates at a speed in proportion to the speed of said main drive means.

14. A trailing edge folding accessory apparatus, for use in combination with a carton blank folding machine having support means for continuously advancing blanks in a predetermined direction in untimed relationship to one another along a generally horizontal path in said folding machine, the apparatus operating to fold a trailing blank panel 180° about a fold line that extends generally transverse to the advancement path, which apparatus comprises means for sensing the presence of a blank at a location along said path and providing a signal, means for continuously measuring incremental advance of said support means and providing a signal, a rotatable shaft mounted below said path and transvere thereto, a continuously rotating drive means, vacuum-operated clutch means for alternately associating and dissocating said rotatable shaft with said continuously rotating drive means to, cause said shaft to be selectively driven from said driven means, vacuum-operated brake means to stop said shaft in precise positions, a pair of arms each having an inner end and an outer end, said inner ends being mounted at diametrically opposed locations on said shaft to extend said arms radially therefrom, an elongated head at said outer end of each arm, one arm being carried by said shaft from a first dwell position to a second position just above and generally parallel to said path extending downstream horizontally from said upper end, to a third dwell position with the opposite head in said first position and to a fourth position with said opposite head in the second position, programmable control means connected to said sensing means and said measuring means, said control means operating said clutch to associate said shaft to the rotation of said drive means following detection of said blank at said location and after a measured incremental advance of said support means, causing said one head to be carried from said first to said second position at a certain instant following detection of said blank at said location, said control means operating said clutch means to dissociate said shaft from the rotation of said drive means and operating said brake means to stop said shaft with said one head precisely in said second position, and after an adjustable pause period that is determined by a measured increment of advance of said support means, said control unit again operating said clutch means to associate said shaft to the rotation of said drive means causing said shaft to further rotate to said third dwell position.

15. Apparatus in accordance with claim 14 wherein said control means is electronic and is adjustable to adapt to trailing panels having a different dimension between the trailing edge and the transverse fold line by entering therein indicia equivalent to said dimension.

16. Apparatus in accordance with claim 14 wherein plow means is located above said support means where a portion of said trailing panel is engaged and bent backwards as said folding is carried out, said plow means extending downstream of said shaft and serving to hold down said folded panel after sliding from under said head.

17. Apparatus in accordance with claim 14 wherein said folding machine has main drive means and wherein said drive means is interconnected with said main drive means and automatically rotates at a speed in proportion to the speed of said main drive means.

18. Apparatus in accordance with claim 14 wherein said drive means is designed to operate at variable speed, and said control means is adapted to monitor said drive means speed and to incorporate same in calculating said certain instant, whereby causing said drive means to operate at a faster speed results in said head means initially contacting the trailing panel of the blank at a location relatively closer to its trailing edge.

* * * * *

UNITED STATES PATENT AND TRADEMARK OFFICE

CERTIFICATE OF CORRECTION

PATENT NO. : 4,432,745

DATED : February 21, 1984

INVENTOR(S) : Charles W. Eldridge

It is certified that error appears in the above-identified patent and that said Letters Patent is hereby corrected as shown below:

Column 2, lines 30-31, "provided" should read --provide--.

Column 2, line 33, "imtermittently" should read --intermittently--.

Column 9, line 38, "transvere" should read --transverse--.

Column 9, line 41, "dissocating" should read --dissociating--.

Column 9, line 42, after "to" delete the comma (,).

Column 9, line 43, "driven" should read --drive-- (Second instance).

Signed and Sealed this

Twenty-ninth Day of January 1985

[SEAL]

*Attest:*

DONALD J. QUIGG

*Attesting Officer* *Acting Commissioner of Patents and Trademarks*